US006192206B1

(12) United States Patent
Peters et al.

(10) Patent No.: US 6,192,206 B1
(45) Date of Patent: Feb. 20, 2001

(54) APPARATUS AND METHOD FOR SHUTTING-DOWN A REPRODUCTION APPARATUS IN A PRESCRIBED MANNER

(75) Inventors: Johannes H. T. Peters, Venlo; Xavier C. M. Brankaert, Weert, both of (NL)

(73) Assignee: Océ-Technologies B.V., Venlo (NL)

( * ) Notice: Under 35 U.S.C. 154(b), the term of this patent shall be extended for 0 days.

(21) Appl. No.: 09/219,122

(22) Filed: Dec. 23, 1998

(30) Foreign Application Priority Data

Dec. 23, 1997 (NL) ..... 1007875

(51) Int. Cl.[7] ..... G03G 21/14
(52) U.S. Cl. ..... 399/77; 713/324
(58) Field of Search ..... 399/77, 88, 90, 399/11, 37, 75; 713/320, 321, 324

(56) References Cited

U.S. PATENT DOCUMENTS

| | | | | |
|---|---|---|---|---|
| 4,615,609 | * | 10/1986 | Honma | 399/88 |
| 4,677,310 | * | 6/1987 | Midorikawa et al. | 307/64 |
| 4,870,526 | | 9/1989 | Maruta et al. . | |
| 5,241,402 | | 8/1993 | Aboujaoude et al. . | |
| 5,305,058 | * | 4/1994 | Sulenski et al. | 399/159 |
| 5,394,251 | * | 2/1995 | Aikens | 358/500 |
| 5,546,164 | | 8/1996 | Hayashi et al. . | |
| 5,710,959 | | 1/1998 | Hirooka et al. . | |
| 5,784,628 | * | 7/1998 | Reneris | 713/300 |
| 5,915,148 | * | 6/1999 | Hamaguchi et al. | 399/77 |
| 5,923,919 | * | 7/1999 | Nimura et al. | 399/37 |

FOREIGN PATENT DOCUMENTS

| | | |
|---|---|---|
| 58-203462 | 11/1983 | (JP) . |
| 62-294265 | 12/1987 | (JP) . |
| 09191568 | 7/1997 | (JP) . |

* cited by examiner

*Primary Examiner*—Robert Beatty

(57) ABSTRACT

A reproduction apparatus is provided with a timer for starting a shutdown procedure at a time programmable by an operator. If the external power supply is switched off thereafter, as is the case if the apparatus is connected to an external timer, the apparatus will be switched off in a state suitable for the purpose, so that no data is lost and a hard disk present in the apparatus will not be damaged. A message is generated relating to the time still available until switch-off time. A print job is inhibited depending on the time still available.

17 Claims, 8 Drawing Sheets

APPARATUS AND METHOD FOR SHUTTING-DOWN A REPRODUCTION APPARATUS IN A PRESCRIBED MANNER

BACKGROUND OF THE INVENTION

1. Technical Field of the Invention

The invention relates to a reproduction apparatus for producing prints on a medium that includes a printing unit and a control unit, the control unit being required to run through a shutdown procedure prior to the switching off the control unit.

2. Description of Related Art

Digital reproduction machines are generally constructed from at least two basic units: a print unit and a control unit. The print unit, or engine, ensures that electronic image information available in the form of a bitmap is printed on an image carrier, such as paper for example. The control unit, also known as the "controller" or "front-end", has the task of converting incoming print jobs to a form suitable for the print unit, buffering them if necessary, and, at the time that the print unit indicates that it is ready for printing, sending the necessary information to the print unit.

A control unit is frequently embodied by the use of one or more hardware components such as a CPU board, a hard disk, and a network card and one or more software components, such as an operating system, drivers, and application programs.

Since a control unit must be capable of processing large quantities of information in a short time, dedicated hardware and software components have hitherto been used for the purpose. The mass production of personal computers, however, has resulted in ever-faster general purpose hardware components and general purpose operating systems becoming available.

Recently there has also been a trend to base reproduction system control units on these general purpose hardware and software components. Advantages are, on the one hand, the lower cost of these standard components in comparison with the development costs required for dedicated components and, on the other hand, the continuing development of these standard components to ever faster processing speeds, so that future reproduction machines which, as a result of trends toward higher resolution, higher production, more refined image processing and color, make ever-increasing demands of processing speed of the control unit, will still be able to use such standard components.

One property of these general purpose systems is frequently the fact that if they are switched off a shutdown procedure should be run through before the system really may be switched off in a safe and problem-free manner. The shutdown procedure terminates all the current actions of the control unit in the correct manner and so that data stored during operation of the system in different volatile memories and buffers can be written to a writable permanent memory, e.g. a hard disk in the system itself or storage unit on a server, which can be accessed via a network. In this way, the system is brought into a definite state before switching off and no data are lost.

If the system is switched off without the shutdown procedure being run through, the system becomes corrupted, which means that when the system is subsequently started it is no longer possible to find all the required data so that the system is in an error mode. A hard disk contained in the system may also be damaged if the system is repeatedly shut down without running through a shutdown procedure.

In reproduction apparatus, and particularly reproduction apparatus which is unmanned in a generally accessible area and intended for general use, it is conventional to connect such apparatus to an external timer, which switches the apparatus on and off at preset times.

In the case of reproduction apparatus equipped with a control unit having a shutdown procedure, this method of operation causes problems and inconvenience. The control unit should run through a shutdown procedure beforehand; if this is overlooked, the apparatus will be switched off without running through the shutdown procedure, with all the above-described disadvantageous consequences thereof.

SUMMARY OF THE INVENTION

The object of the invention is to remedy the above-noted problems.

To achieve this object, the inventive reproduction apparatus is provided with a timer for starting the control unit shutdown procedure at times programmed by an operator.

As a result, the invention starts a shutdown procedure automatically just before the external timer comes into operation, so that if the machine is switched off by the timer, the control unit is already in a suitable state for switching off thereafter.

One advantageous embodiment includes a timer unit suitable for switching the apparatus on and off at times programmed by an operator. No external timer is required in this embodiment. The programming of a shutdown time after the external timer switch-off time by mistake can no longer occur.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
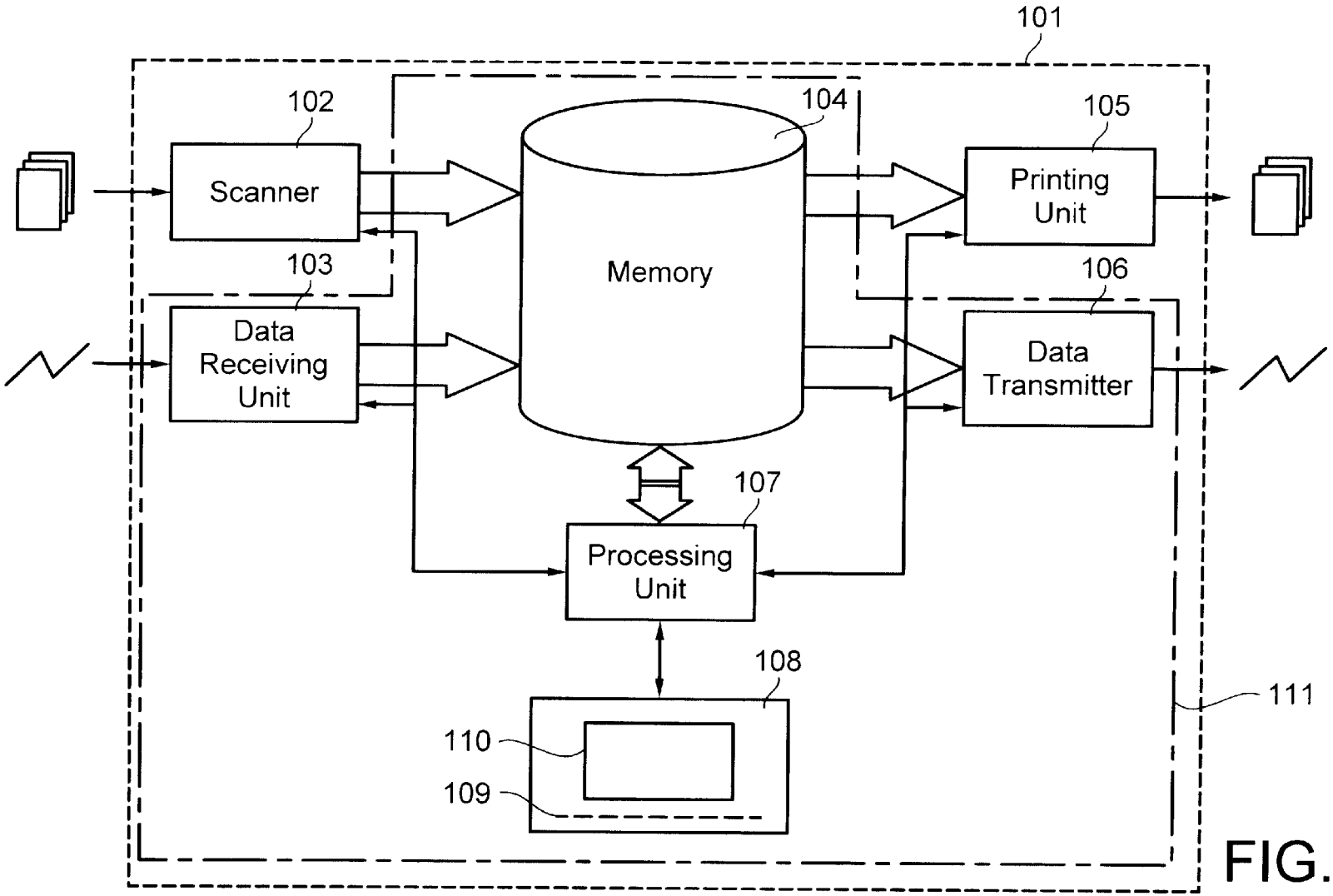
FIG. 1 is a diagrammatic illustration of a reproduction apparatus.

FIG. 1 is a diagram showing a reproduction apparatus 101 according to the invention. The reproduction apparatus according to the embodiment described here offers the user a copying function, a print function and a scan function.

In the copying function, the operator first of all inputs the required settings for the copying job via the operator control unit 108. For this purpose unit 108 includes an operator control panel provided with a number of keys 109 grouped around a screen 110. Together with standard values for unchanged settings, the settings thus input form the job specification.

The paper originals associated with the job are then scanned in through the agency of the scanner 102. The job specification together with the electronic original images obtained through the agency of the scanner 102 are stored as the copying job in the memory 104.

All the data-processing functions and control functions are accommodated in a processing unit 107. Processing unit 107 manages a queue of jobs stored in the memory and ensures that when the copying job is next in line for printing the electronic original images and the associated job specification are passed to printing means 105. The latter further ensure that the prints are made in accordance with the job specification.

In the printing function, print jobs including a number of electronic original images and a job specification are received by the data receiving unit 103. These print jobs originate, for example, from workstations connected to the reproduction apparatus 101 via a network. On receipt, the job is stored as a print job in the queue in the memory 104.

Via the operator control unit 108 it is possible to amend the job specification while the job is still in the memory 104. Further processing is identical to the above-described processing of a copying job.

The scanning function is intended to scan in paper originals and then send them in electronic form to a destination station via a network. For this purpose, the operator first of all inputs a job specification for the scanning job via the operator control unit 108. The original images are then read in via the scanner 102 and then stored in the storage unit 104. From here they are fed, under the control of the processing unit 107, to the data transmitter 106, which is also supplied with the correct addressing for the network.

Processing unit 107 includes a timer unit which can be adjusted via operator control panel 108 to start a shutdown procedure. In the shutdown procedure, printed circuit boards accommodating the control circuits for the modules shown in the drawing are brought into an idle mode, whereafter the apparatus can be switched off.

Processing unit 107, memory 104, data receiver and data transmitter 103 and 106, and operator control unit 108 in the embodiment illustrated all form part of the operator control unit 111, which, for embodying the above functional modules, also includes application software, operating system software, drivers, a hard disk, and a number of printed circuit boards such as a mother board, a network card and a video card.

Figure 2:
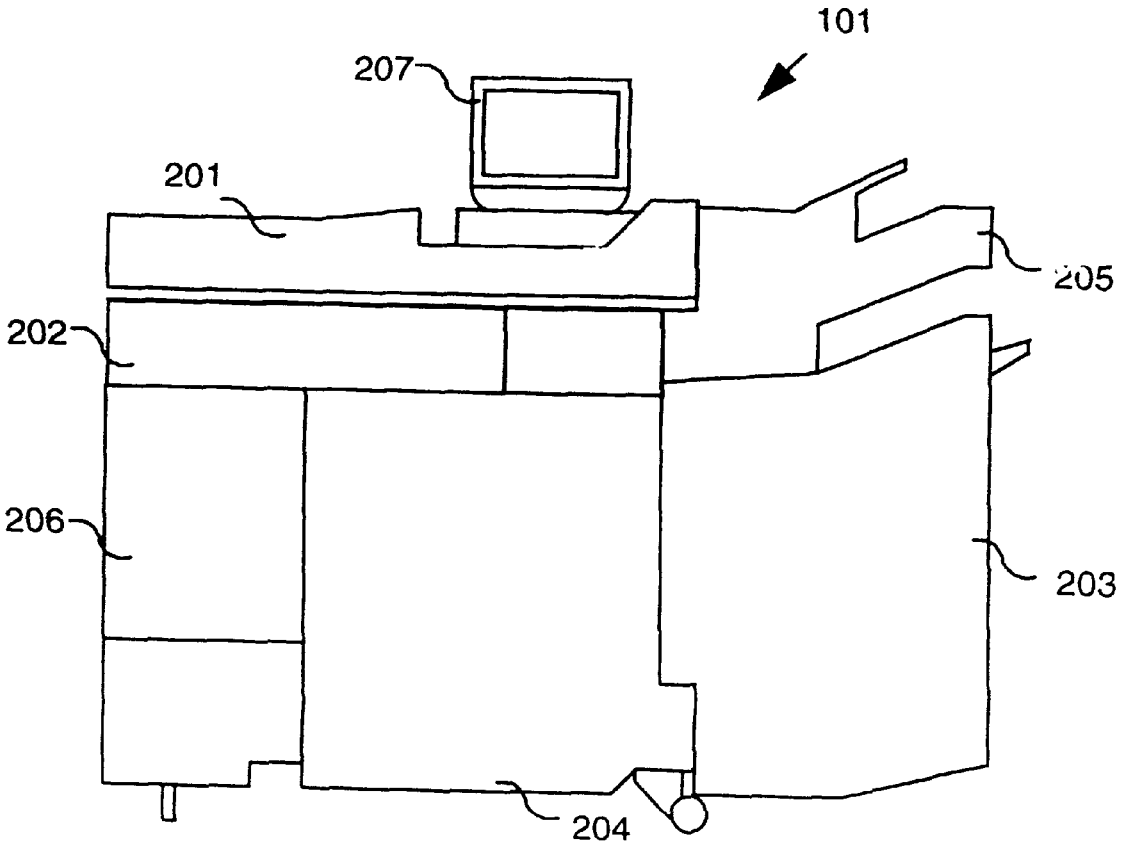
FIG. 2 is an external view of one embodiment of a reproduction apparatus.

FIG. 2 is an external view of one embodiment of the reproduction apparatus 101. In the embodiment illustrated, the scanner includes a scanner unit 202 and an automatic page feeder 201 for automatically feeding an original sheet or stack of original sheets placed therein to the scanner unit 202. The latter optically scans an original sheet fed thereto and converts the optical information into electrical image signals by means of photoelectric sensors such as a CCD. The printer in the embodiment illustrated includes a reservoir for copy material 203, a printing unit 204 and a finishing module 205 for finishing and depositing the printed copy sheets.

The image formation by the printing unit 204 can be accomplished in various ways. For example it is possible to use electrophotography with a photoconductor and laser or LED exposure or, for example, an inkjet.

In addition, the image formation need not be restricted to one color, but can also comprise a background color or even full color. Control unit 111 including memory 104 is accommodated in a compartment of the apparatus having the reference 206.

The storage unit 104 is constructed as a combination of a hard disk and a RAM. The operator control panel 207 of the operator control unit 108 is disposed at the center of the apparatus at a height such that all the keys are readily accessible and the screen readily visible to a standing operator.

Figure 3:
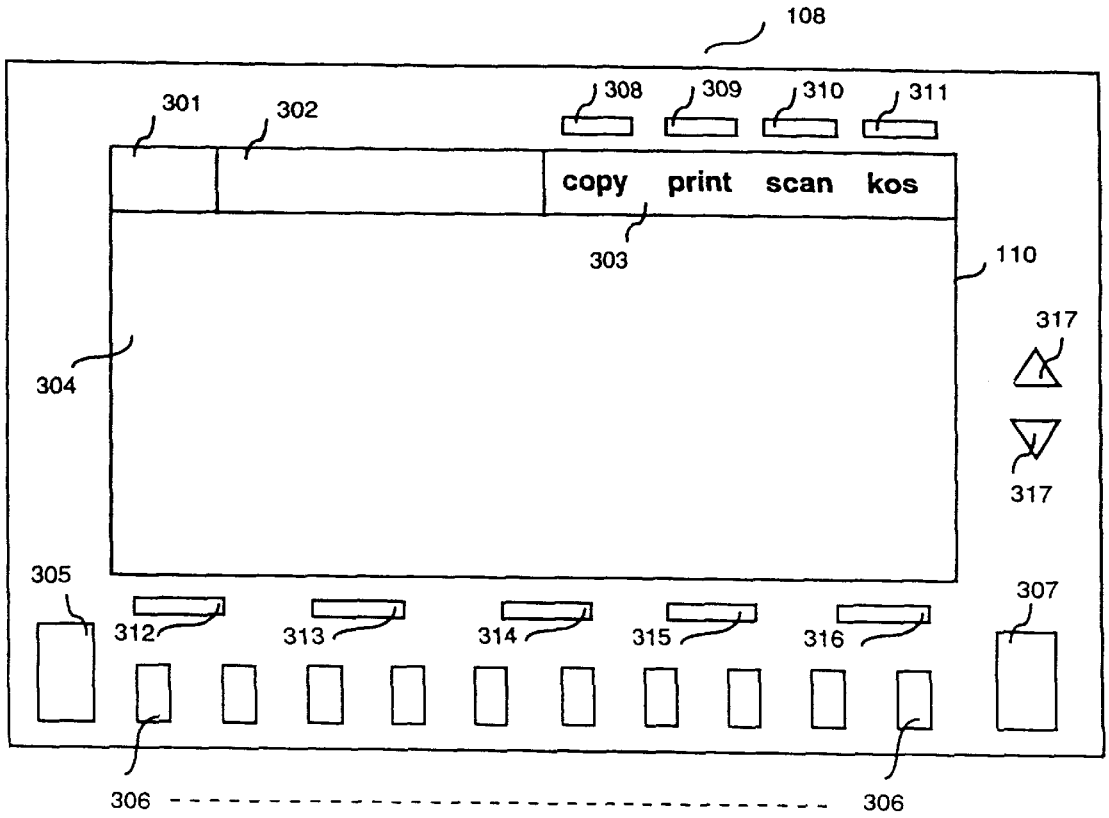
FIG. 3 is an elevation of the control unit according to the invention.

FIG. 3 shows a further development of the operator control panel 207 of the reproduction apparatus. The operator control panel includes a display screen 304 and a number of keys. The display screen 110 is of the LCD type and the screen content can be defined to the pixel level. The display screen is divided up into a number of screen areas denoted by references 301, 302, 303 and 304. Screen area 301 shows the number of copies or copy sets to be made. Screen area 302 shows apparatus messages, such as error messages or status messages. Screen area 303 indicates the above-mentioned main functions for selection, and finally screen area 304 shows main menus and any sub-menus.

A start key 305, number keys 306 and a correction key 307 are disposed at the bottom of the panel. The start key 305 is used to start up a job to be performed by the reproduction apparatus, e.g. copying an original sheet or sheets fed in the original feeder. Start key 305 is also used to confirm settings made. The number of prints that can be made can be set by the number keys 306. The number set for a reproduction job is displayed in screen section 301. The correction key 307 is used to interrupt the copying process and cancel any settings made.

Directly around the display screen 110 are a number of keys which can be coupled functionally with a specific area on the display screen. Keys 308, 309 and 310 are used to call up main menus for, respectively, copying, scanning and printing. Key 311 is used to activate a key operator function indicated by 'kos'. The key functions are displayed in the screen area 303, the selected function being shown with a different background from the other functions.

The main menu and any sub-menus are displayed in screen area 304. The latter is divided into five columns, each column being provided with a cascade key, references 312 to 316 respectively. Each column contains alternative options for a function and the respective cascade keys which select a following option on each activation can be used to make a selection. Finally, a number value for an option can be selected if necessary with the up-down keys 317.

Figure 4:
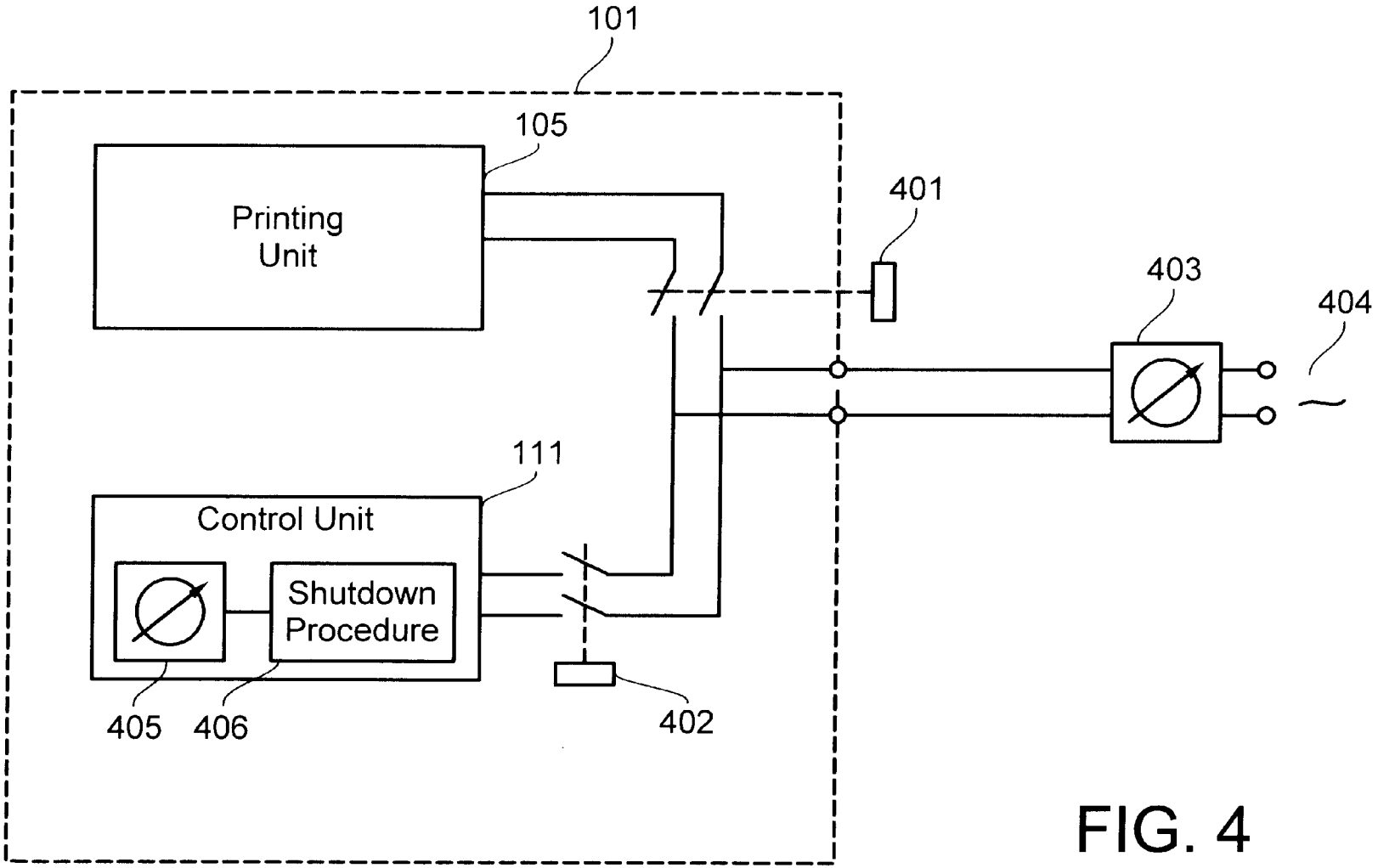
FIG. 4 is a diagram showing a first embodiment of a reproduction apparatus according to the invention.

FIG. 4 diagrammatically illustrates a first embodiment of the invention in which reproduction apparatus 101 is shown with printing unit 105 and control unit 111. The reproduction apparatus is provided with a main switch 401 operable on the outside of the apparatus. This main switch 401 is used only to switch printing unit 105 on and off.

Control unit 111 receives voltage via switch 402. This switch 402 can be operated only on the inside of the apparatus and is used for servicing and maintenance.

The reproduction apparatus is connected to a power supply (mains) 404 via an external timer 403. The latter is automatically switched on and off daily at fixed times set by a key operator. In this configuration, the external timer 403 is disposed in the mains supply line to the reproduction apparatus.

Of course it is also possible to switch the mains connection 404 on and off centrally at set times.

According to the invention, the apparatus is now provided with a time switch 405 which, at an adjustable time, delivers a signal by means of which a shutdown procedure, denoted by reference 406 in the drawing, is started by the control unit 111.

Figure 5:
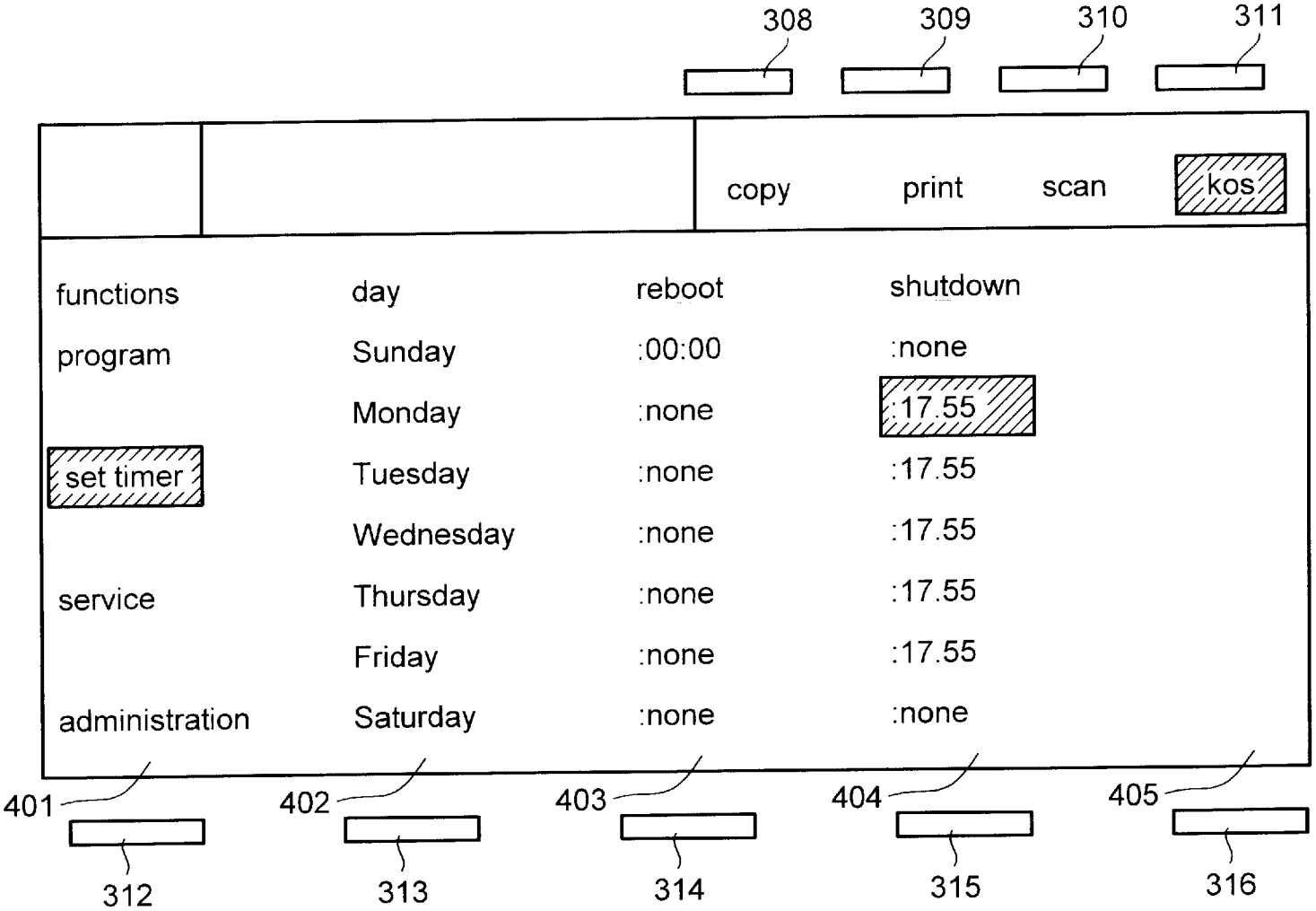
FIG. 5 shows an operating screen for setting the time scale.

FIG. 5 shows an operating screen for setting times at which shutdown is to take place and the times at which rebooting must take place. The operating screen can be called up only by a key operator, who activates the key operating system operationally by selecting "kos" with key 311, after which a password must be input and, if the user really is authorized, a number of key operator functions will be displayed in column 401. The key operator selects a function with the aid of cascade key 312.

With the function "program" it is possible to call up an operating screen with which a shutdown procedure and a reboot procedure can be defined as a sequence of required actions which is to be run through. FIG. 5 shows that the function "set timer" has been selected. In this case, the sub-menu as shown in the cascade columns 402–404 is displayed.

Two times can be set for each day of the week: a time at which rebooting of the system is to take place and a time at which a shutdown procedure 406 must be carried out. Column 402 displays the days of the week. In columns 403 and 404, at positions corresponding to the days from column 402, fields are displayed for the times at which rebooting and shutdown are to be started respectively. A field is selected by activating cascade key 314 or 315: activation of a key results in selection of a following field in the column, of course with the top field following the bottom field.

If a field has been selected from one of the columns 403 or 404, a time can be input here with the number keys 306. If a timer is to be rendered inoperative for a specific day and a specific function (rebooting or shutdown), this is done by activating correction key 307. The message "none" then appears in the time field.

Rebooting has been set in FIG. 5 only on Sunday. This rebooting action differs from the booting procedure normally taking place when the apparatus is switched on, inasmuch as it is so programmed (with the program menu) that a number of extra actions take place, for example cleaning up and checking the hard disk. If all the required times have been input in this way, another operating screen can be selected or else KOS can be left and the apparatus will perform the set actions at the times that have been input.

The operator will input shutdown times which are sufficiently suitable for the time when the supply from the mains is interrupted. The result of this is that before the apparatus is automatically switched off those parts of the apparatus for which a shutdown procedure has been specified are also enabled to run through the shutdown procedure before the apparatus is actually switched off.

With this embodiment according to the invention it is still possible to use an external timer or a power supply circuit which is switched on and off centrally, while nevertheless preventing automatic switching on of the apparatus from resulting in the apparatus entering an error mode which can be cancelled only by intervention on the part of the operator.

Figure 6:
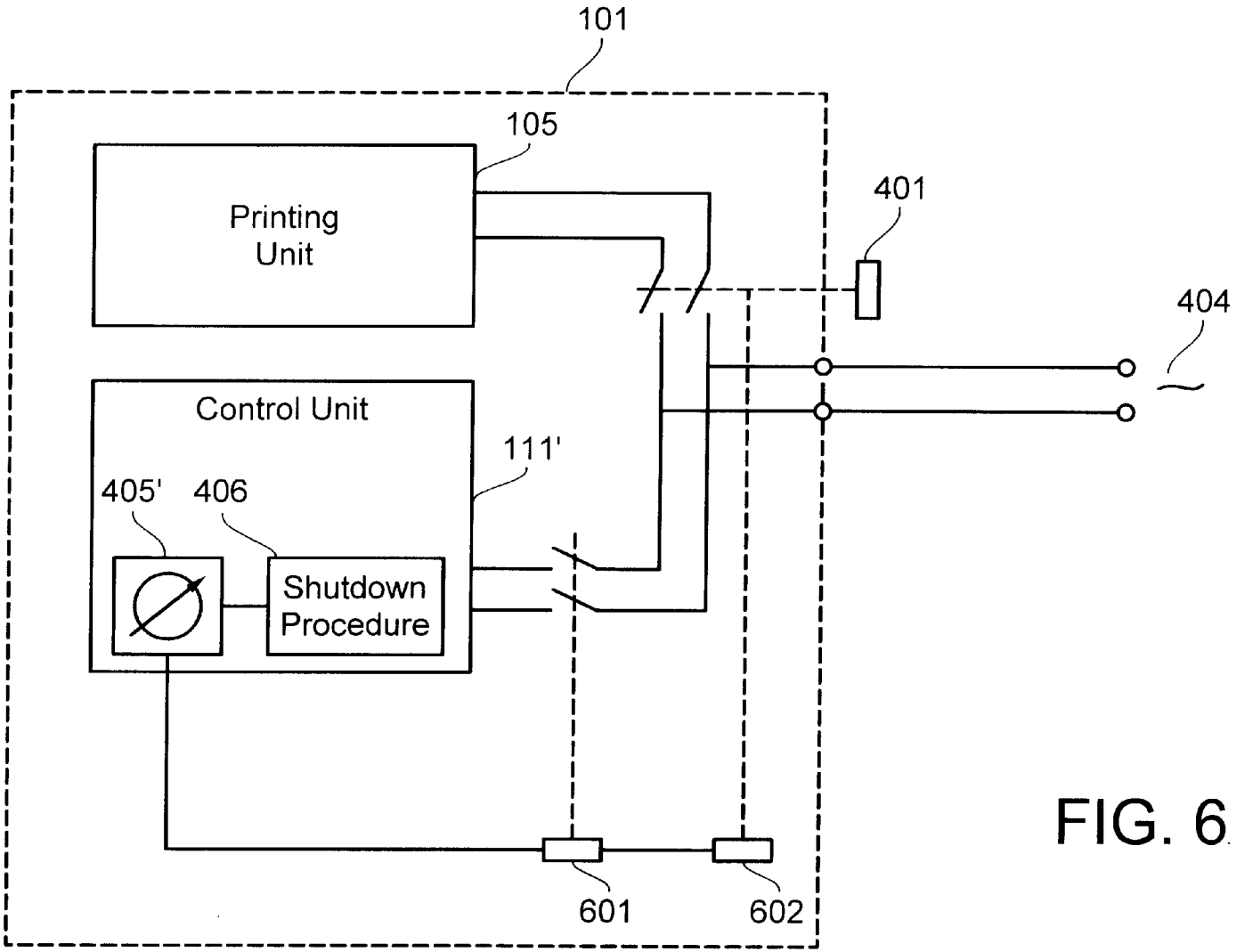
FIG. 6 is a diagram showing a second embodiment of a reproduction appratus according to the invention.

FIG. 6 shows a second embodiment of a reproduction apparatus according to the invention in which no external timer is required or used to switch the apparatus on and off at set times. The time switch 405' to be set by the operator is so constructed that it is coupled via a suitable interface to electrically energized switches 601 and 602. The time switch 405' ensures that the shutdown procedure is initiated first of all. If the shutdown procedure has been run through, the system delivers signals to switches 601 and 602 so that they are energized and opened.

During the time that the apparatus is switched off, the internal clock of the control unit 111' will run on and the time switch 405' remains operative. For this purpose the control unit 111' is provided with a battery or accumulator. At the time when the apparatus is to be switched on again, the time switch 405' delivers a signal to the electrically energized switches 601 and 602, so that they close and the control unit 111' starts with a booting procedure and the printing unit starts with the heating-up procedure.

For servicing purposes, it is still possible to switch the printing unit 105 off with switch 401 while the control unit 111' remains switched on. Switch 601 is also operable manually, so that only the control unit can be switched off for maintenance purposes.

The switches 601 and 602 are energized from a supply module (not shown), which is connected in the power supply line upstream of the switch contacts of the switches 601 and 602. This supply module is thus always connected to the mains. For this purpose it is also possible to use an accumulator which is charged during operation.

Figure 7:
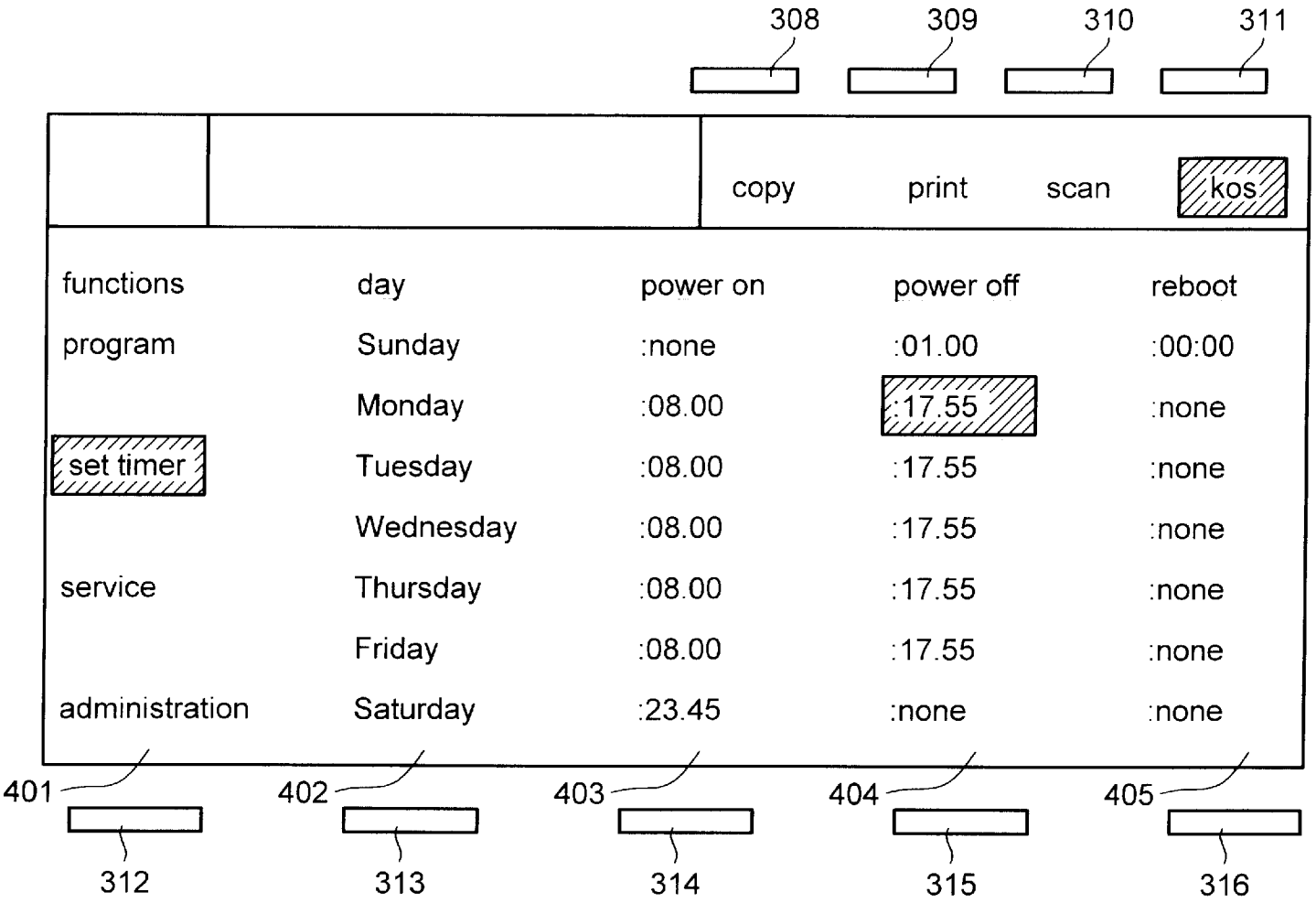
FIG. 7 is an operating screen for setting the timers in the second embodiment.

The accumulator can also be used to keep the control unit 111' in the switched-on state in the event of a supply failure, so that it can initialize a shutdown procedure, after which the control unit is switched off. The operating screen for setting the timers for this configuration is shown in FIG. 7. Operation thereof is similar to the operation as described in connection with FIG. 5.

Figure 8:
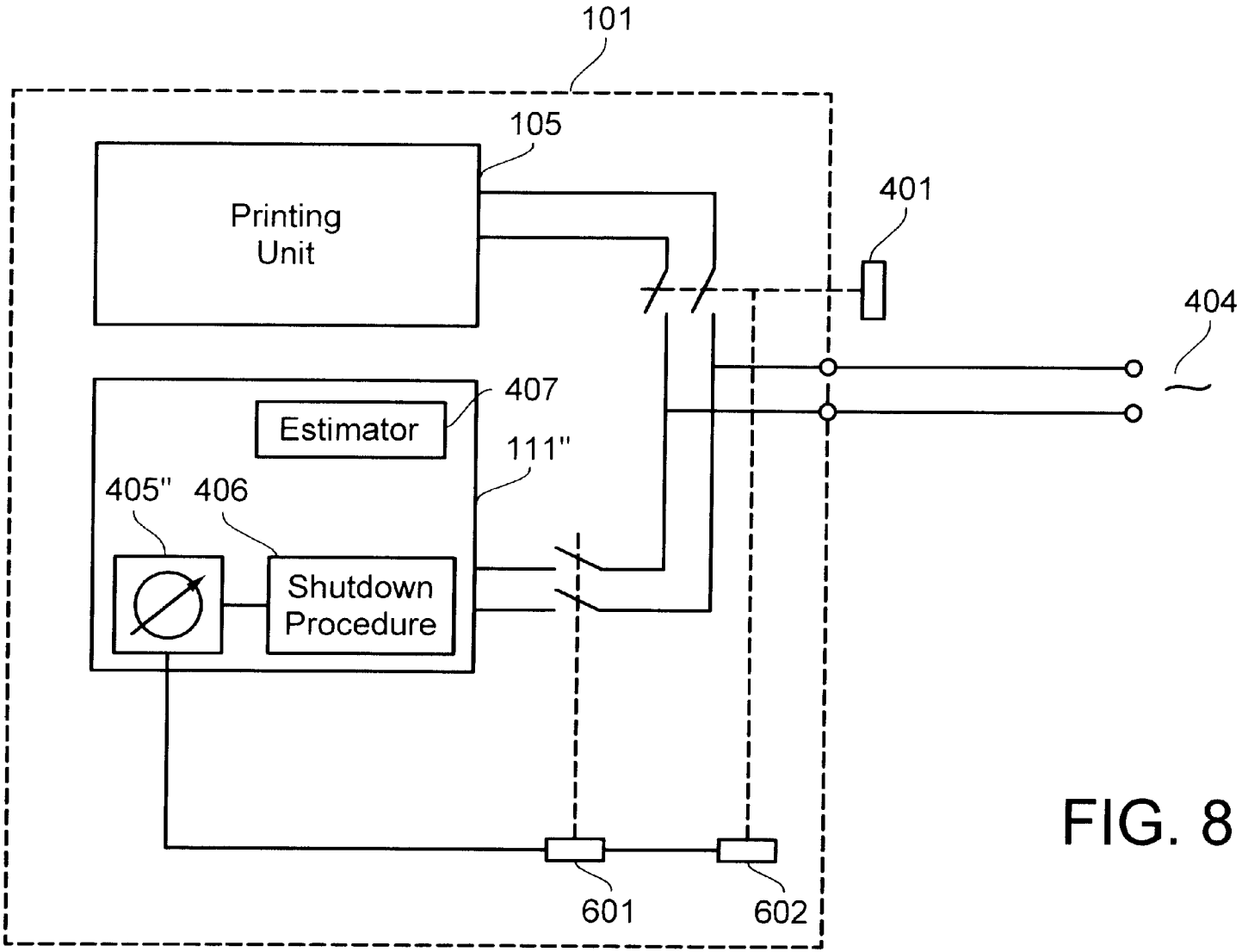
FIG. 8 is a diagram showing a modification to the first and second embodiments of a reproduction apparatus according to the invention.

The ease of use of the apparatus according to one of the preceding configurations is increased by the apparatus giving a message if a job cannot be finished in the remaining time still available to the apparatus. For this purpose, the control unit 111" is provided with an estimator 407 as shown in FIGS. 8 that estimates how long a job will take.

In the case of a copying job, the basis used by this estimator 407 is the number of pages to be printed and a fixed time per page, a different fixed time per page being used if duplex printing is required. If the user has made all the settings and the start button has been activated to carry out the job, the estimator 407 then calculates the time required for this job for each original, calculates how many originals can be processed in the time available until the apparatus is switched off, and displays a message on the operator control panel in screen area 302 to the effect that only if the job consists of the calculated number of originals as a maximum can the job be processed in its entirety.

If the start button is activated again, the user cancels the warning and starts the apparatus with the processing of the print job. However, at the instant that the shutdown procedure is started the job is interrupted and not carried out further.

The user also has the opportunity, before re-activating the start button, of reducing the number of copies so that the printing job can be processed in the available time. This procedure for calculating whether a job can still be processed will be operative from a certain time before the switching off of the apparatus. In processing print jobs, in calculating the estimate for the processing time for a print job, in addition to the details given above, the data format supplied is also taken into account to enable an estimate to be made of the time required for interpretation. The number of bitmaps to be printed is also determined from the available data. The calculated processing time based thereon is compared with the available time by the estimator 407. If this time is too short, the job is not processed. following print job can then be processed.

A unit is also provided for displaying on the screen area 302 a essage indicating that the apparatus is switched off for a specific period, his messaging being displayed at set times prior to switching off.

In another variation, the timer (405 or 405') can also be set from a remote workstation connected via data receiving unit 103 and data transmitter unit 106 to the processing unit 107.

It is also possible to program the timer (405 or 405') by transmitting a data file from a remote workstation, which data file can be interpreted by the processing unit 107. The rebooting and shutdown sequences can also be input to the reproduction apparatus in these ways. These operator remote control facilities are of advantage primarily if a large number of reproduction machines are controlled from a central point.

It should be noted that the control unit (111, 111' or 111") which a shutdown procedure has to pass through is not restricted to the control unit described here, but can also be a different control unit. For example it may be a control unit for a delivery unit with which the reproduction apparatus is provided (e.g. a sorter, folder, and so on).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A reproduction apparatus for producing prints on a medium comprising:

a printing unit;

a control unit, said control unit being required to run through a shutdown procedure prior to switching-off of said control unit in order to prevent malfunctions or other problems;

timer means for starting the shutdown procedure at times programmed by an operator; and means for generating a system message relating to the time still available until the switch-off time.

2. The reproduction apparatus according to claim 1, said timer means switching the reproduction apparatus on and off at times programmed by an operator.

3. The reproduction apparatus according claim 1, said timer means starting a rebooting procedure of said control unit at the time programmed by an operator.

4. The reproduction apparatus according claim 2, said timer means starting a rebooting procedure of said control unit at the time programmed by an operator.

5. The reproduction apparatus according claim 1, said timer means switching said printing unit on and off at times programmed by an operator, while said control unit remains switched on.

6. The reproduction apparatus according claim 3, said timer means switching said printing unit on and off at times programmed by an operator, while said control unit remains switched on.

7. The reproduction apparatus according claim 4, said timer means switching said printing unit on and off at times programmed by an operator, while said control unit remains switched on.

8. The reproduction apparatus according to claim 1, further comprising:

data communication means for communicating data to the reproduction apparatus thereby permitting programming of the times via said data communication means.

9. The reproduction apparatus according to claim 3, wherein the rebooting procedure and the shutdown procedure can be programmed by the operator.

10. The reproduction apparatus according to claim 4, wherein the rebooting procedure and the shutdown procedure can be programmed by the operator.

11. A reproduction apparatus adapted to process jobs for producing prints on a medium comprising:

a printing unit;

a control unit, said control unit being required to run through a shutdown procedure prior to switching-off of said control unit in order to prevent malfunctions or other problems;

timer means for starting the shutdown procedure at times programmed by an operator; and means for determining an estimated processing time for a job, for comparing the estimated processing time with an available time determined by the programmed switching-off time, and for either generating a warning message or inhibiting starting of the job if the estimated processing time is longer than the available time.

12. The reproduction apparatus according to claim 11 further comprising:

means for generating a system message relating to the time still available until the switch-off time.

13. The reproduction apparatus according claim 11, said timer means switching said printing unit on and off at times programmed by an operator, while said control unit remains switched on.

14. The reproduction apparatus according to claim 11, wherein the job is a printing job.

15. The reproduction apparatus according to claim 11, wherein the job is a copying job.

16. A reproduction apparatus for producing prints on a medium comprising:

a printing unit;

a control unit, said control unit being required to run through a shutdown procedure prior to switching-off of said control unit in order to prevent malfunctions or other problems;

timer means for starting the shutdown procedure at times programmed by an operator, said timer means switching the reproduction apparatus on and off at times programmed by an operator; and means for determining an estimated processing time for a print job, for comparing the estimated processing time with an available time determined by the programmed switching-off time, and for generating a warning message if the estimated processing time is longer than the available time.

17. A reproduction apparatus for producing prints on a medium comprising:

a printing unit;

a control unit, said control unit being required to run through a shutdown procedure prior to switching-off of said control unit in order to prevent malfunctions or other problems;

timer means for starting the shutdown procedure at times programmed by an operator, said timer means switching the reproduction apparatus on and off at times programmed by an operator; and means for generating a system message relating to the time still available until the switch-off time.

* * * * *